United States Patent [19]

DiBuono

[11] 3,969,817

[45] July 20, 1976

[54] SHAVING MOISTURIZER DEVICE

[76] Inventor: Frank M. DiBuono, 68 Merrit St., Port Chester, N.Y. 10573

[22] Filed: Apr. 15, 1975

[21] Appl. No.: 568,210

[52] U.S. Cl. ..... 30/41

[51] Int. Cl.[2] ..... B26B 21/40

[58] Field of Search ..... 16/169, 149; 30/41, 30/90

[56] References Cited

UNITED STATES PATENTS 3,853,371 12/1974 Bienert ..... 16/169

FOREIGN PATENTS OR APPLICATIONS 66,602 1/1957 France ..... 30/41

*Primary Examiner*—Al Lawrence Smith
*Assistant Examiner*—Gary L. Smith
*Attorney, Agent, or Firm*—John F. Ohlandt

[57] ABSTRACT

A moisturizer device is incorporated as an integral part of a disposable razor head for applying moisture and heat to the face in a shaving operation; the device takes the form of a sponge applicator held within a slot in the razor head, the slot being defined by a lower flap hingedly related to the upper part or body of the razor head.

3 Claims, 6 Drawing Figures

FIG. 1
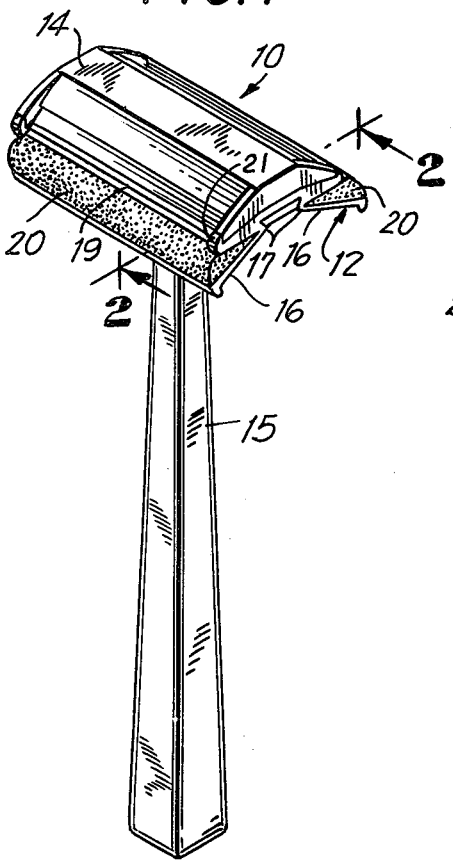
FIG. 2
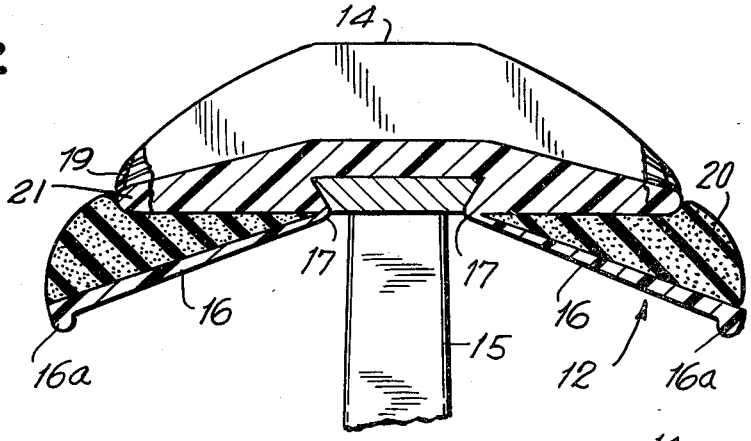
FIG. 3
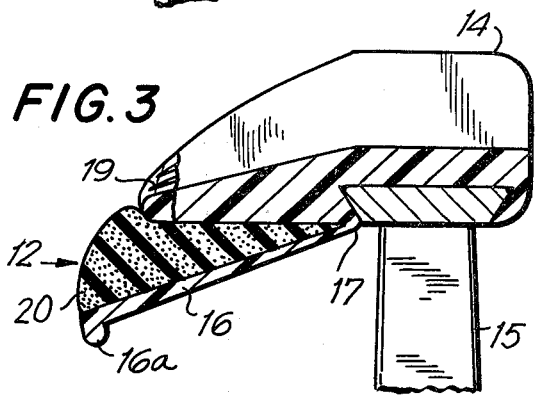
FIG. 4
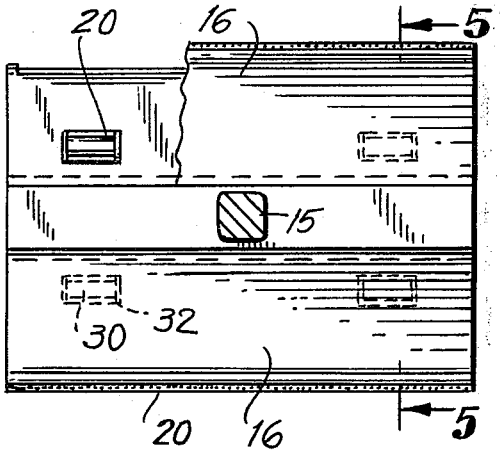
FIG. 5
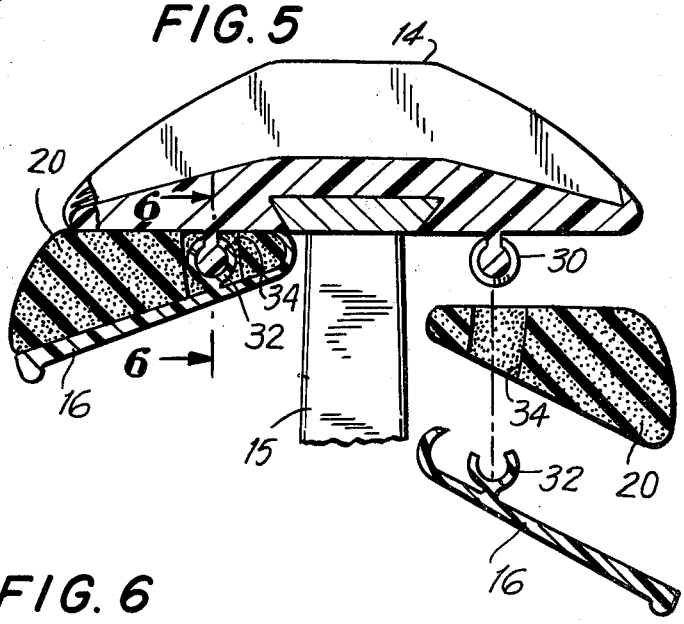
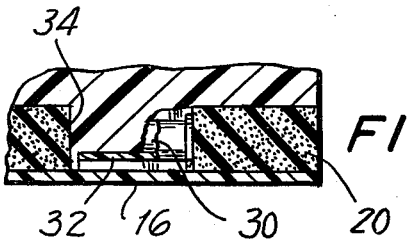
FIG. 6

SHAVING MOISTURIZER DEVICE

BACKGROUND, OBJECTS AND SUMMARY OF THE INVENTION

The present invention pertains to shaving apparatus and, more particularly, to a moisturizing device incorporated as an integral part of a razor head in which a razor blade is held or encapsulated.

In order to provide background for a complete understanding of the present invention, reference may be made to certain prior art patents, such as U.S. Pat. Nos. 1,825,335 to Connolly; 2,600,880 to Karle; 2,677,883 to Schallgruber; 2,861,338 to Boland and 3,768,161 to Miller. In one form or another, the patented devices include a roller or sponge applicator or the like, particularly for dispensing moisture and lubricants.

In the case of the Karle patent, there is specifically provided a moisture-retaining pad disposed immediately in advance of the cutting edge of a razor. However, for reasons which will become apparent, the present invention is directed to a variety of objects not considered or fulfilled by the aforesaid prior art.

In particular, it is a primary object of the present invention to provide a moisturizing device in the form of a moisture-retaining pad uniquely incorporated as an integral or unitary part of the razor blade head and so situated relative to the razor blade that the area of skin immediately in advance of the blade can, by suitable manipulation of the razor head, have moisture applied with precise regulation.

Another object of the present invention is to provide a moisture-retaining pad or applicator so related to the razor blade head and so disposed with reference to the user's face that the moisturizing pad or applicator will be judiciously squeezed or have pressure applied to it whereby moisture and/or lather can be expressed onto the user's face so as to promote efficiency and comfort in shaving.

The aforesaid objects are fulfilled and implemented by means of a primary feature of the present invention which comprises a razor blade head, preferably constituted of plastic, in which the blade is firmly held or encapsulated, and in which a suitable slot or slots are formed at the lower edges of such head. The slot or slots are defined by a flap or pair of flaps situated at the under surface of the head, such flap or flaps having either been formed integrally in the manufacturing process of forming the head or having been made integral with the remainder of the head at a later stage. The flaps are preferably composed of the same plastic material as the head itself, thereby possessing great resiliency or flexibility so as to allow the moisturizing applicator or sponge to be readily squeezed as the downward shaving stroke is accomplished. As a result, the shaver is able to regulate precisely the amount of moisture in the form of hot water and lather introduced to the face and beard by the amount of pressure applied in the shaving operation.

Other and further objects, advantages and features of the present invention will be understood by reference to the following specification in conjunction with the annexed drawings, in which like parts have been given like numbers.

BRIEF DESCRIPTION OF THE DRAWINGS

FIG. 1 is a perspective view of a razor device, including a razor head and an integrally formed moisturizing device therein, in accordance with a first preferred embodiment.

FIG. 2 is a sectional view taken on the line 2—2 of the razor device seen in FIG. 1.

FIG. 3 is a fragmentary view of a single-edge-blade version of the first embodiment.

FIG. 4 is a bottom plan view of the razor head illustrating the use of axles molded as part of the head in accordance with a second preferred embodiment.

FIG. 5 is a sectional view taken on the line 5—5 of the razor head of FIG. 4 according to the second embodiment.

FIG. 6 is a fragmentary view taken on the line 6—6 of FIG. 5.

DESCRIPTION OF PREFERRED EMBODIMENTS

Referring now to the figures of the drawing, and particularly for the moment to FIG. 1, there will be seen a razor 10 which features a moisturizing device or devices 12 in accordance with the first preferred embodiment. The razor 10 is so constituted as to include a disposable plastic head 14 which is unitarily formed or molded in the shape depicted, and adapted to be mounted on a stem 15. This head 14 is molded of a typically hard but resilient and flexible plastic material. The head 14 is so formed as to include a flexible lower flap 16 or flaps 16 hingedly connected to the body of the head 14. This can be accomplished by self-hinging, that is to say, the flap is formed in the mold so as to be integral with the rest of the head but with a very thin section joining the flap with the rest of the head so that the flap can be moved about the junction line 17 very easily.

It will be seen in FIG. 1 that a slot or opening 18 is defined by each of the lower flaps 16 and the upper part of the head 14. The moisturizing applicator takes the form of a sponge pad or pads 20 suitably configured so that they can be disposed within the slots 18. The sponge pads 20 are bonded to the upper part or body of the head 14 by means of a suitable adhesive and each is also bonded to one of the lower flaps 16. The sponge pads 20 are preferably configured to have a trapezoidal cross-section and when disposed in the slots 18 extend laterally downwardly so as to contact the face of the user with a cushioning effect. The single-edge-blade version, substantially similar to the device in FIG. 1, is seen in FIG. 3.

It will be appreciated that the edge of the razor head that first contacts the user's face, assuming that the razor is properly deployed, is the outer edge 16A of one of the lower flaps 16. This results from the fact that the outer edge 16A is on or ahead (in the direction away from the head) of a line which is tangent to the edge 21 of the body and at least one of the edges of the blades 19. These flaps, as aforenoted, being hingedly related to the upper part or body of the plastic head 14, so as to be readily moved about the self-hinging or junction line 17, will act to squeeze the moisturizing pad or applicator 20 so as to produce the desired effect upon the pad, thereby to express or release moisture and accumulated lather onto an appropriate spot on the user's face just in advance of the application of the blade. The blade 19 is so encapsulated within the plastic head 10 that it extends laterally in such manner as to be slightly short of the longitudinal edge 21 of the upper part or body, that is, the portion just above the sponge pad, such edge acting as a guard or safety means.

It will be noted that a series of slots can be provided transversely through this guard portion. As a result, if desired, moisture can be expressed through the slots. However, it has been found preferable that these slots be eliminated, thereby promoting a retention of moisture at the inner part of the sponge pad.

The razor head of the present invention can take another form or embodiment. Referring now to FIGS. 4–6, the second embodiment is therein illustrated. Instead of the lower flap or flaps 16 being integrally formed in the mold or otherwise integrally bonded with the main part of the razor head, the second embodiment provides that a number of axles be formed, preferably integrally with the formation of the upper part of the razor head 14. These axles are designated 30 and can be appreciated in their longitudinal extent by reference to FIG. 4.

A corresponding or matching pair of clamps 32 is provided on the lower flap or flaps 16. These clamps are arranged to fit through suitable openings 34 provided in the sponge pad or applicator 20. Thus, when the lower flap or flaps 16 are to be engaged with the main part or body of the razor head 14 the clamps 32 are fitted through the openings 34 and these clamps are adapted to grip firmly the axle or axles 30. Accordingly, as in the first embodiment, the flaps 16 are thereby hingedly related to the main part of the razor head and, as before, the flaps will be moved in response to contact with the user's face so as to apply pressure to one of the sponge pads or applicators 20.

It will be appreciated from FIGS. 4–6 that the lower flap in this second embodiment is restrained from moving below a fixed point because the inner part of the lower flap will butt against the upper part or body of the razor head, thereby allowing the lower flap to move or to give in only one direction so as to produce the requisite squeezing of the sponge pad or moisture applicator. It will automatically return to that original position because of the inherent resilience of the compressed sponge pad.

It will be understood by those skilled in the art that other means and methods of achieving the assembly of the moisture pad or applicator in accordance with the principles disclosed can be readily adoted. Thus, other hinging arrangements can be provided such as by using rivets to affix the lower flap to the body of the razor head. Also, although it has been indicated that plastic is preferable for the entire construction including the lower flap 18 such that such lower flap is inherently flexible, it is possible to utilize a rigid flap of either plastic or metal.

While there have been shown and described what are considered at present to be the preferred embodiments of the present invention, it will be appreciated by those skilled in the art that modifications of such embodiments may be made. It is therefore desired that the invention not be limited to these embodiments, and it is intended to cover in the appended claims all such modifications as fall within the true spirit and scope of the invention.

What is claimed is:

1. A shaving moisturizer device comprising a razor head adapted to be mounted on a stem;

a blade mounted in said head;

said head comprising a main part or body and a lower flap, said lower flap being formed integrally or unitarily with the main part or body of the razor head, said lower flap having hinge means mounting it to said main part or body and defining with said part or body a slot;

a moisture applicator disposed along and within the aforesaid slot; and the outer edge of said lower flap being on or ahead of a line which is tangent to the edge of the body of said razor head and passes through the cutting edge, the lower flap contacts the user's face ahead of contact by the moisture applicator and is operable to produce pressure on the moisture applicator so as to express moisture onto the user's face.

2. A device as defined in claim 1, in which the aforesaid hinge means is defined by integrally formed axles on the main part or body of the razor head and by clamps formed on the lower flap.

3. A device as defined in claim 2, in which openings are provided in the moisture applicator so that said clamps can be fitted therethrough, thereby to engage with the aforesaid axles.

* * * * *